US005727395A

United States Patent [19]

Guo et al.

[11] Patent Number: 5,727,395

[45] Date of Patent: Mar. 17, 1998

[54] DEFROST CONTROL FOR HEAT PUMP

[75] Inventors: Zhichao Guo, Fayetteville; Robert P. Dolan, Syracuse; Kevin A. Kimberly, Marietta; Kevin F. Dudley, Cazenovia; Thomas R. Phillips, Cicero, all of N.Y.

[73] Assignee: Carrier Corporation, Syracuse, N.Y.

[21] Appl. No.: 800,480

[22] Filed: Feb. 14, 1997

[51] Int. Cl.[6] ..... F25D 47/02

[52] U.S. Cl. ..... 62/156; 62/80; 62/155

[58] Field of Search ..... 62/156, 80, 81, 62/82, 151, 152, 154, 155, 234, 160, 208, 209; 165/231, 232, 233

[56] References Cited

U.S. PATENT DOCUMENTS 3,777,505 12/1973 Otaki ..... 62/156 X 4,373,349 2/1983 Mueller ..... 62/155 X 4,882,908 11/1989 White ..... 165/233 X 5,179,841 1/1993 Phillips et al. ..... 62/81

*Primary Examiner*—Harry B. Tanner

[57] ABSTRACT

A defrost control for a heat pump system initiates a defrost when certain computed conditions are exceeded. The conditions include a limit as to the difference that may be permitted between the maximum temperature difference of two measured temperatures and the current difference of these measured temperatures. The two measured temperatures are the temperature of the indoor coil of the heat pump and the indoor air temperature of the air being heated by the indoor coil.

20 Claims, 8 Drawing Sheets

DEFROST CONTROL FOR HEAT PUMP

BACKGROUND OF THE INVENTION

This invention relates generally to defrosting the outdoor coil of a heat pump system and, more particularly, to an apparatus and method for timely initiating the defrosting action of the outdoor coil.

One of the frequently encountered problems associated with an air source heat pump system is that during heating operations, the outdoor coil will tend to accumulate frost under certain outdoor ambient conditions. The accumulation of frost on the outdoor coil produces an insulating effect which reduces the heat transfer between the refrigerant flowing through the coil and the surrounding medium. Consequently, after a build up of frost on the outdoor coil, the heat pump system will lose heating capacity and the entire system will operate less efficiently. It is therefore desirable to initiate defrost before this build up of frost occurs thereby impacting the efficiency of the heat pump. It is also desirable to not unnecessarily initiate a defrost of the outdoor coil until such frosting occurs since each defrost of an outdoor coil removes heat from the enclosure to be heated due to the reversal of the refrigeration system.

Different types of defrost initiation systems have been utilized to timely initiate defrost. These systems have included the monitoring of certain temperature conditions experienced by the heat pump system. These temperatures conditions are usually compared against certain predetermined limits. These predetermined limits are usually fixed and do not take into account changes in the manner in which the heat pump may be operating.

SUMMARY OF THE INVENTION

It is an object of the invention to initiate a defrost action only after certain temperature measurements are performed and compared with real time computations as to the appropriate threshold values for the sensed temperature conditions.

It is another object of the invention to control the initiation of a defrost action so as to thereby minimize the number of defrost cycles which otherwise might occur due to prematurely triggering defrost as a result of comparing temperature conditions against only predetermined thresholds that do not always accurately reflect when defrost should occur.

The above and other objects of the invention are achieved by providing a programmed computer control for a heat pump system that initiates defrost action only when the same becomes necessary as a result of having computed on a real time basis the appropriate threshold to be used against certain sensed temperatures. The programmed computer control first computes the current difference between the indoor coil temperature of the heat pump system and the room air temperature of the room or space being heated by the heat pump system. This computed current difference in temperature is examined for being greater than any previously computed maximum temperature difference of these two measured temperatures that may have occurred following a previous defrost of the outdoor coil. The currently computed temperature difference becomes the maximum temperature difference in the event that it exceeds any such previously computed maximum temperature difference.

It should be noted that the above computation eliminates any indoor air influence on the behavior of the indoor coil temperature. In this regard, any drop in temperature experienced by the coil due to, for instance, air currents within the room is nullified since both the room air temperature as well as the coil temperature will have dropped.

It should also be noted that the above computations as to differences between indoor coil temperature and room air temperature are also preferably conditioned upon certain other parameters of the heat pump system having also met certain criteria. In particular, the indoor fan associated with the indoor coil must not have changed fan speed within a predetermined period of time during which the compressor and outdoor fan remain on.

The difference between the present maximum temperature difference of the indoor coil temperature and the room air temperature and the present actual difference of these two temperatures is next computed by the programmed computer. This difference between these two previously computed temperature differences will ultimately be compared against a limit to the permissible difference that may be allowed between these two previously computed temperature differences.

In accordance with the invention, the limit to the permissible difference that may be allowed is itself a function of the maximum temperature difference. Since the present value of the maximum temperature difference is continually computed, the resulting limit to the permissible difference can also be continually computed.

In accordance with the invention, a defrosting of the outside coil is preferably initiated if the difference between the present maximum difference in the temperature of the indoor coil and the room air versus the actual difference in the currently measured values of these two temperatures exceeds the computed limit for this allowable difference. This initiation of a defrosting of the outside coil is however also preferably made subject to certain further parameters such as the total time of operation of the heat pump system's compressor and the actual outdoor coil temperature.

The mathematical relationship used to compute the aforementioned limit is preferably derived by observing the operation of a heat pump system having the characteristics of the particular heat pump system being controlled. These observations include initiating a heating operation of such a heat pump system under a given set of conditions (such as outdoor temperature, indoor room temperature and fan speeds) and noting the indoor coil and indoor air temperatures over time. The indoor coil temperature will increase from room temperature to a maximum value before decreasing due to frost build up on the outside coil. The indoor room temperature will tend to rise to a relatively constant level when compared to the above noted changes to the indoor coil temperature. The maximum temperature difference between these temperatures will occur before the indoor coil temperature begins to drop off. The heat pump system will be continually operated with the temperatures of the indoor coil and the room air temperature being noted. At some point, the temperature of the indoor coil will drop significantly indicating that the outdoor coil has become frosted to the point that the heat transfer of the circulating refrigerant to the indoor coil is substantially impaired. The difference between the maximum recorded difference of indoor coil temperature and indoor room temperature and the difference between these same temperatures when substantial frosting of the outdoor coils occurs is noted as a permissible difference that is not to be exceeded.

The noted permissible difference that is not to be exceeded and the maximum temperature difference will become one point on a graph of maximum noted temperature differences and correspondingly noted permissible differences of measured temperature difference to the maximum temperature difference. It has been found that the ultimately developed mathematical relationship between permissible difference and maximum temperature difference is a non-linear relationship. This non-linear relationship is preferably reduced to a series of linear relationships for ease of computation within the programmed computer controlling the heat pump system.

BRIEF DESCRIPTION OF THE DRAWINGS

Other objects and advantages of the present invention will be apparent from the following detailed description in conjunction with the accompanying drawings, in which:

FIGS. 5A through 5D illustrate the sequence of steps to be performed by the computer control for the heat pump system in carrying out the initiation of a defrost action of the outside coil.

DESCRIPTION OF THE PREFERRED EMBODIMENT

Figure 1:
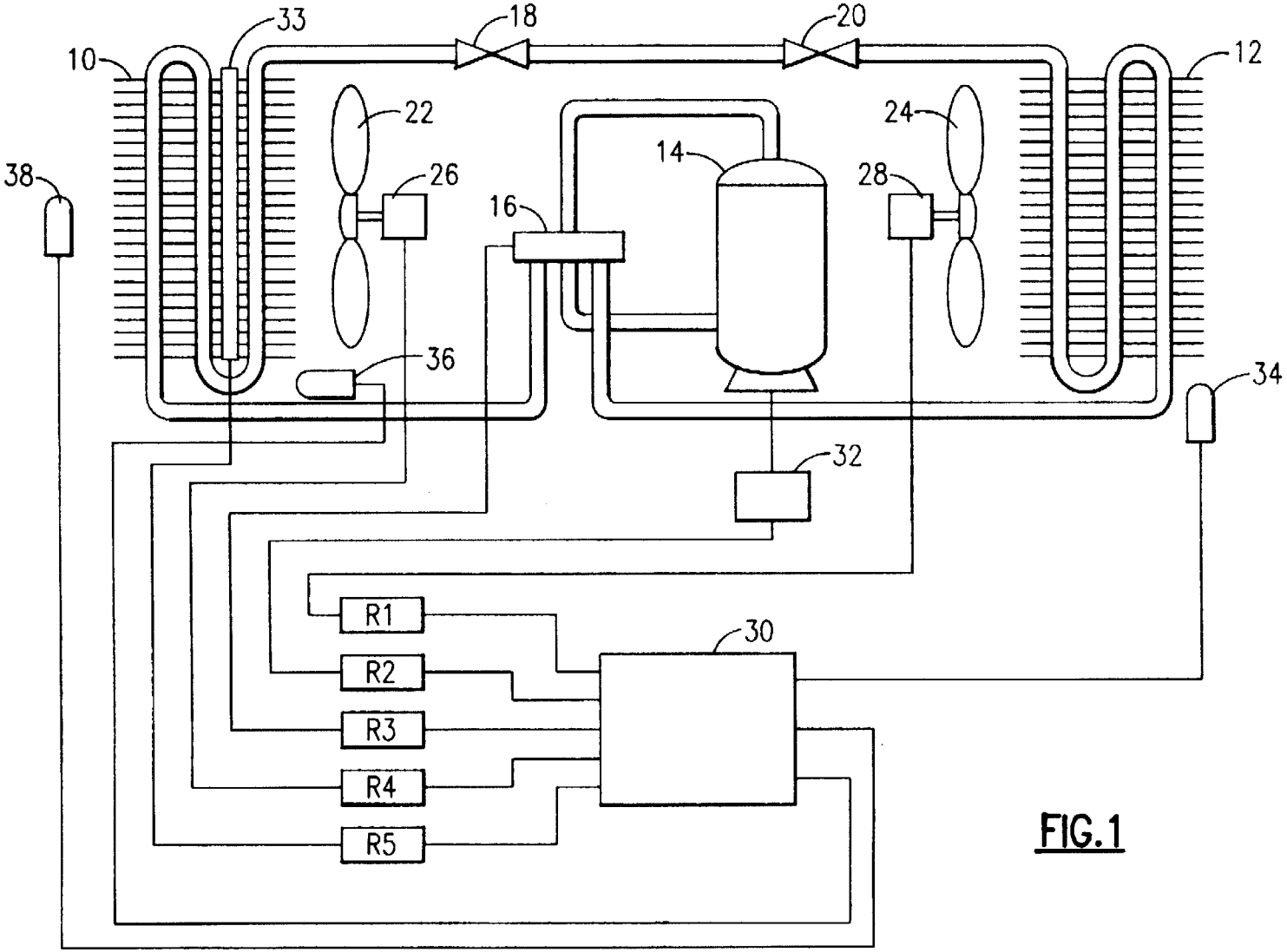
FIG. 1 is a schematic illustration of a heat pump system including a programmed computer control therein.

Referring to FIG. 1, a heat pump system is seen to include an indoor coil 10 and an outdoor coil 12 with a compressor 14 and a reversing valve 16 located therebetween. Also located between the indoor and outdoor coils are a pair of bi-flow expansion valves 18 and 20, which allow refrigerant to flow in either direction as a result of the setting of the reversing valve 16. It is to be appreciated that all of the aforementioned components operate in a rather conventional manner so as to allow the heat pump system to provide cooling to the indoor space while operating in a cooling mode or providing heating to the indoor space while operating in a heating mode.

Indoor fan 22 provides a flow of air over the indoor coil 10 whereas an outdoor fan 24 provides a flow of air over the outdoor coil 12. The indoor fan 22 is driven by a fan motor 26 whereas the outdoor fan 24 is driven by a fan motor 28. It is to be appreciated that the indoor fan motor may have at least two constant drive speeds in the particular embodiment. These drive speeds are preferably commanded by a control processor 30 that controls the fan motor 26 through relay drivers. The fan motor 28 is preferably controlled by relay drive R1. The reversing valve 16 is also controlled by the control processor 30 operating through the relay circuit R3. The compressor 14 is similarly controlled by the control processor 30 acting through relay circuit R2 connected to a compressor motor 32. The control processor 30 furthermore controls an electrical heater element 33 associated with the indoor fan coil 10 through a relay circuit R5. It is to be appreciated that the heating element 33 is part of an auxiliary heating unit, which will normally be activated by the control processor 30 when additional heating is required to the indoor area normally being heated by the heat pump system.

Referring to the control processor 30, it is to be noted that the control processor receives outdoor coil temperature values from a thermistor 34 associated with the outdoor coil 12. The control processor 30 also receives an indoor coil temperature value from a thermistor 36 and an indoor room air temperature from a thermistor 38.

It is to be appreciated that the control processor 30 is operative to initiate a defrost action when certain temperature conditions indicated by the thermistors 34, 36, and 38 occur. In order for the control processor 30 to detect the particular temperature conditions giving rise to a need to defrost, it is necessary that it perform a particular computation involving the indoor coil temperature and the room air temperature as normally provided by thermistors 36 and 38, respectively. The particular computation performed by the control processor is based on having preferably conducted a series of tests of the heat pump system of FIG. 1 as will now be described.

Figure 2:
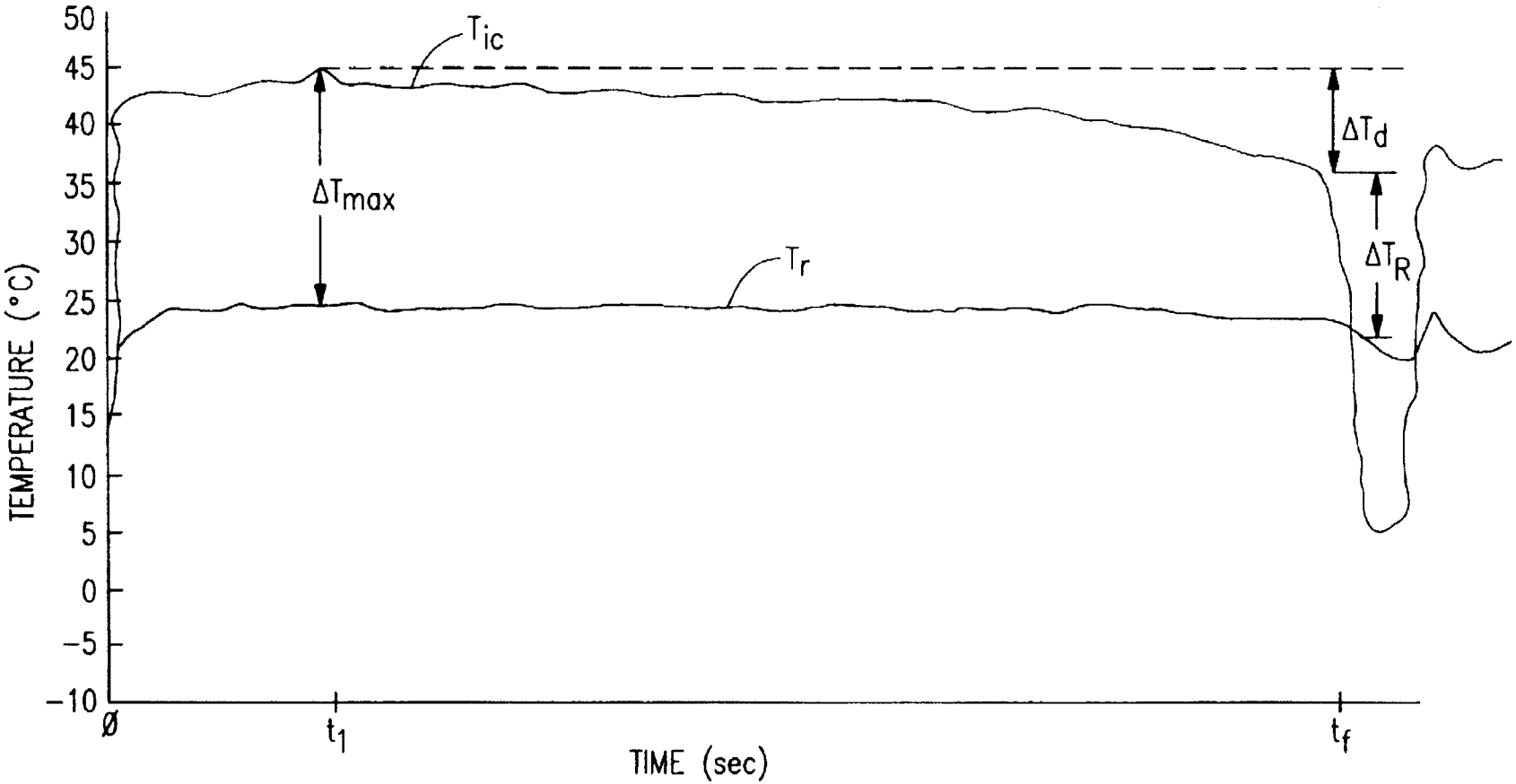
FIG. 2 is an illustration of the temperature pattern of the temperature of the indoor heating coil and the indoor room air temperature produced by the heat pump system of FIG. 1 when in a particular heating situation.

Referring to FIG. 2, a graph depicting the temperature of the indoor coil and the room air temperature of the heat pump system of FIG. 1 for a given heating cycle is illustrated. The heating cycle occurs under a given set of ambient conditions and a given set of system conditions for the heat pump system. The ambient conditions include particular outdoor and beginning indoor air temperatures. The system conditions include particular fan speed settings and a particular amount of refrigerant in the system. The indoor coil temperature as well as the indoor room temperature as measured by thermistors 36 and 38 are noted at periodic time intervals. At some point, the difference between the temperature of the indoor coil, $T_{ic}$ and the indoor room temperature, $T_r$, will have reached a maximum temperature difference as indicated by $\Delta T_{MAX}$ occurring at time $t_i$. The heating cycle will continue beyond $t_i$ with the temperature of the indoor coil $T_{ic}$ dropping off as frost begins to build up on the outdoor coil due to a cool outdoor temperature. At some point in time, $t_f$, a significant amount of frost will have built up on the outdoor coil thereby causing a significant drop-off in the indoor coil temperature. This drop off in the indoor coil temperature is due to the decrease in heat transfer capacity of the circulating refrigerant as a result of a loss in the evaporator efficiency of the frosted outside coil. The difference between the maximum temperature of the indoor coil occurring at $t_i$ and the temperature of the indoor coil occurring at $t_f$ is noted as a defrost delta temperature, $\Delta T_d$. It is to be noted that the temperature difference, $\Delta T_d$, also essentially defines how much the real difference $\Delta T_R$ between the indoor coil and the room air temperature at time $t_f$ may drop relative to $\Delta T_{MAX}$ since the room air temperature does not vary significantly between the time $t_i$ and time $t_f$.

In accordance with the invention, the defrost temperature difference $\Delta T_d$ at time $t_f$ and the value of ΔTMAX at time $t_i$ are both noted for the particular heating run. It is to be understood that additional heating runs will be conducted for other sets of particular ambient conditions and other sets of particular system conditions. The defrost temperature difference $\Delta T_d$ and the maximum temperature difference $\Delta T_{MAX}$ will be noted for each such run. All noted values of $\Delta T_d$ and $\Delta T_{MAX}$ will be thereafter used as datapoints in a graph such as FIG. 3 to define a relationship between $\Delta T_d$ and $\Delta T_{MAX}$.

Figure 3:
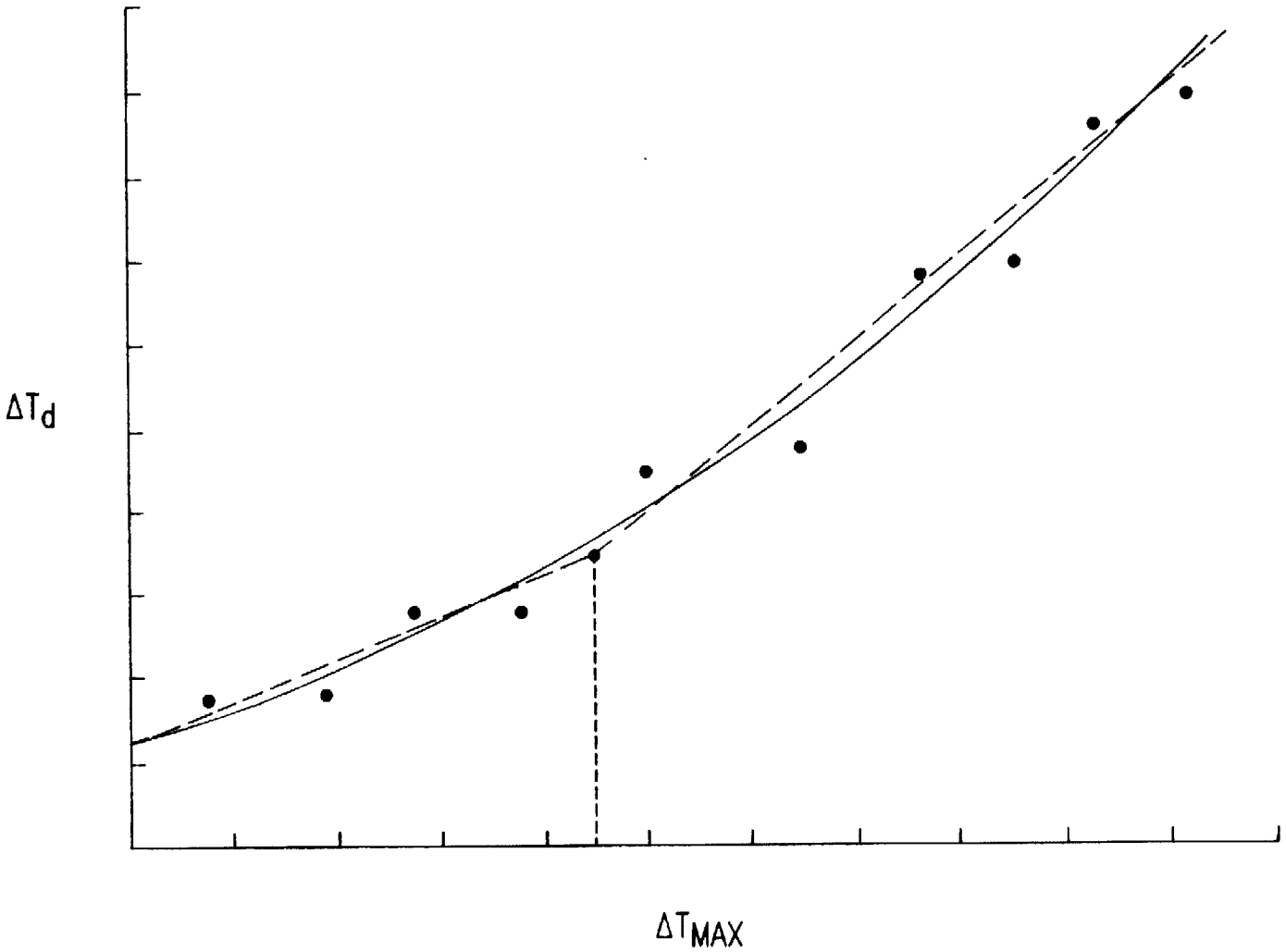
FIG. 3 illustrates how the allowable difference between the maximum difference in these temperatures during a heating cycle and the current difference in the temperature will vary as a function of the maximum difference in temperature will vary as a function of the maximum difference in temperature.

Referring to FIG. 3, the curve drawn through the various data points produced by the heating tests of the heat pump system is seen to be non-linear. This curve is preferably broken down into two linear segments with the first linear segment having a slope S1, ending at a $\Delta T_{MAX}$ of $\Delta T_K$ and the second linear segment having a slope of $S_2$ beginning at the same point. The two linear segments may be expressed as follows:

$$\text{for } \Delta T_{MAX} \leqq \Delta T_K,\ \Delta T_d = S_1 * \Delta T_{MAX} - C_1$$

$$\text{for } \Delta T_{MAX} \geqq \Delta T_K,\ \Delta T_d = S_2 * \Delta T_{MAX} - C_2$$

$C_1$ and $C_2$ are the $\Delta T_d$ coordinate values when $\Delta T_{MAX}$ equals zero for the respective linear segments. It is to be appreciated that the particular values of $\Delta T_K$, $S_1$, $S_2$, $C_1$ and $C_2$ will depend on the particular heat pump system that has been tested. In this regard, the heat pump system will have differently sized components such as fans, fan motors, coil configurations and compressors that would generate their own respective FIGS. 2 and 3 and hence their own respective values of $\Delta T_K$, $S_1$, $S_2$, $C_1$ and $C_2$. As will be explained in detail hereinafter, the linear relationships derived for a particular heat pump system will be used by the control processor 30 in a determination as to when to initiate a defrost of the outdoor coil 12 of such a system.

Figure 4:
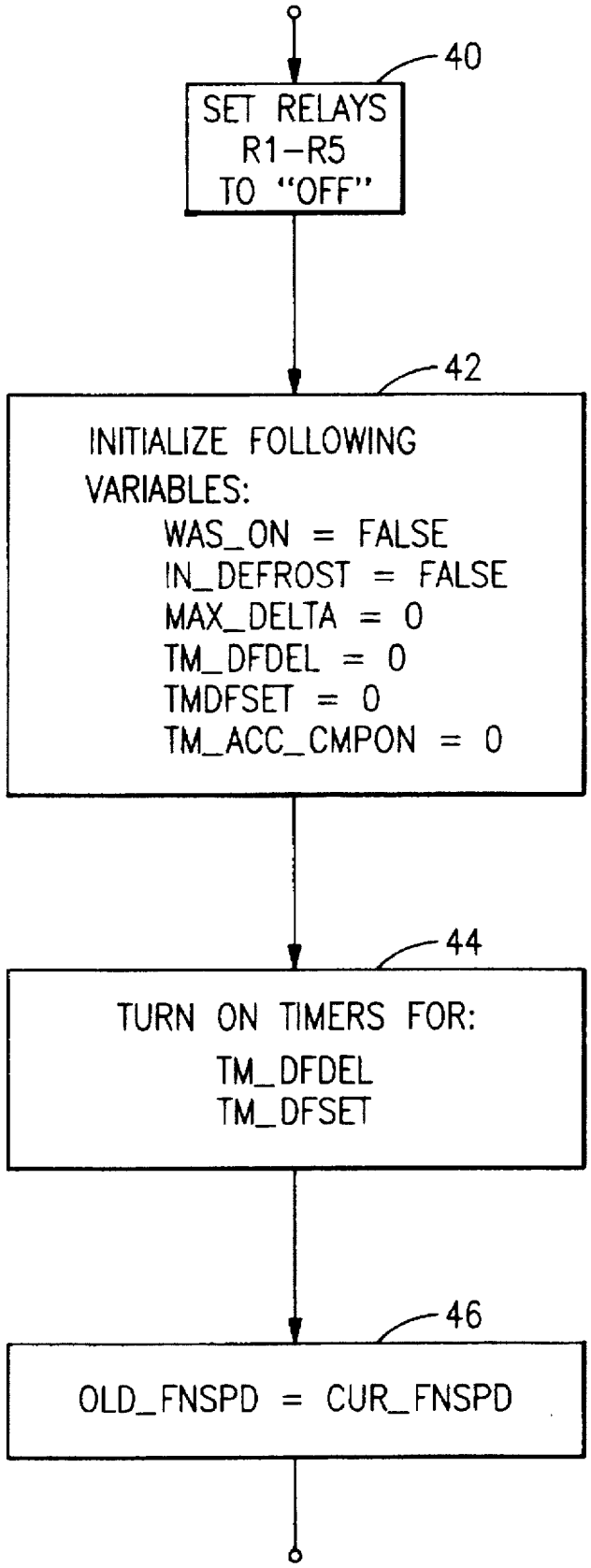
FIG. 4 illustrates a process implemented by the computer control of the heat pump system upon power up of the entire system.

Referring to FIG. 4, a series of initializations are undertaken by the control processor 30 before implementing any defrost control of the heat pump system. These initializations include setting the relays R1 through R5 to an off status so as to thereby place the various heat pump system components associated therewith in appropriate initial conditions. This is accomplished in a step 40. The processor unit proceeds to a step 42 and initializes a number of software variables that will be utilized within the defrost logic. A number of timers are turned on so as to continuously provide times to the variables TM_DFDEL and TM_DFSET. Finally, the processor unit will set a variable, OLD_FNSPD, equal to a current fan speed variable, CUR_FNSPD, in a step 46. It is to be appreciated that the above steps only occur when the processor unit is powered up so as to begin control of the heat pump system.

Figures 5, 5A:
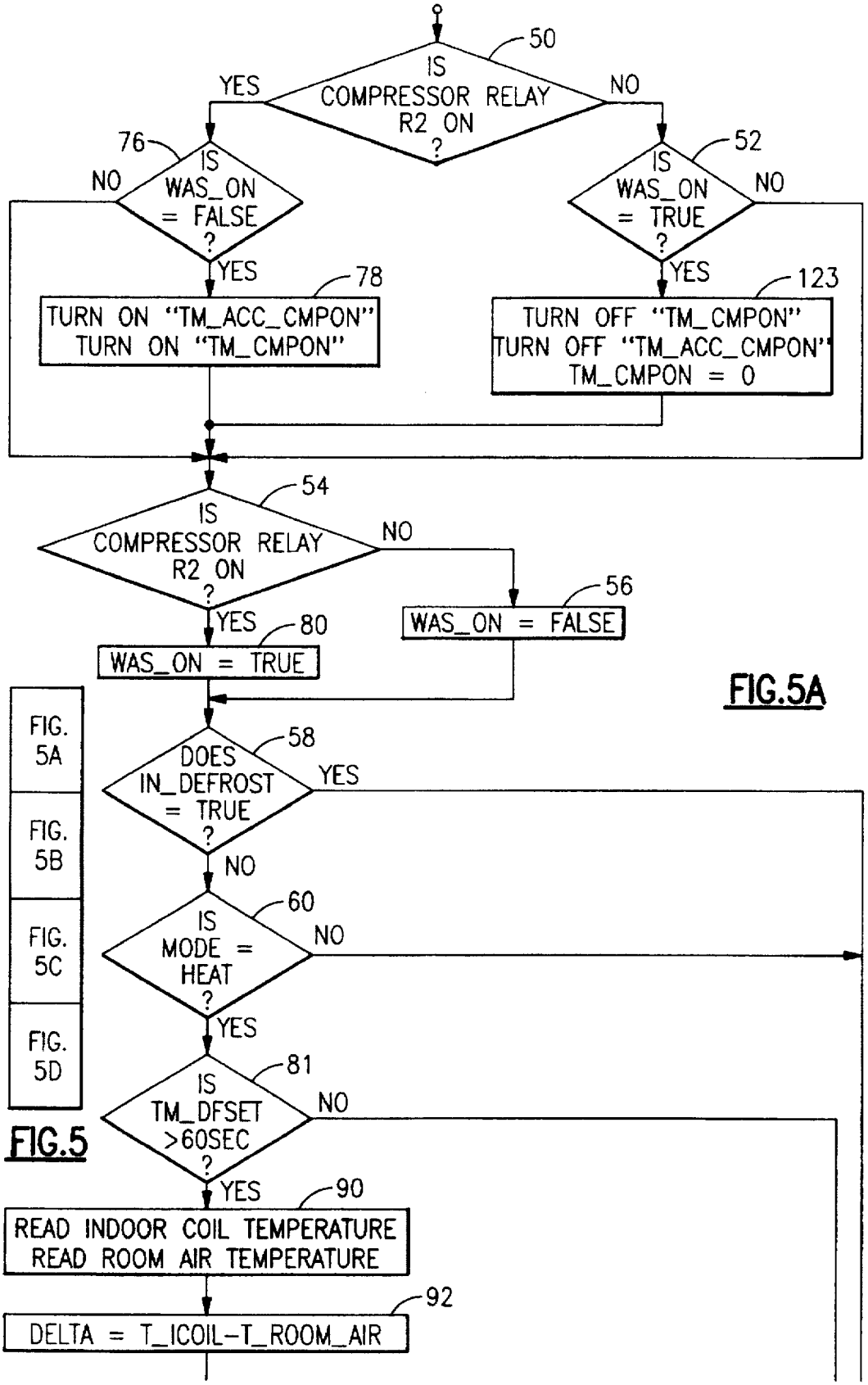
FIG. 5 illustrates how
FIGS. 5A through 5D are aligned.
Figure 5B:
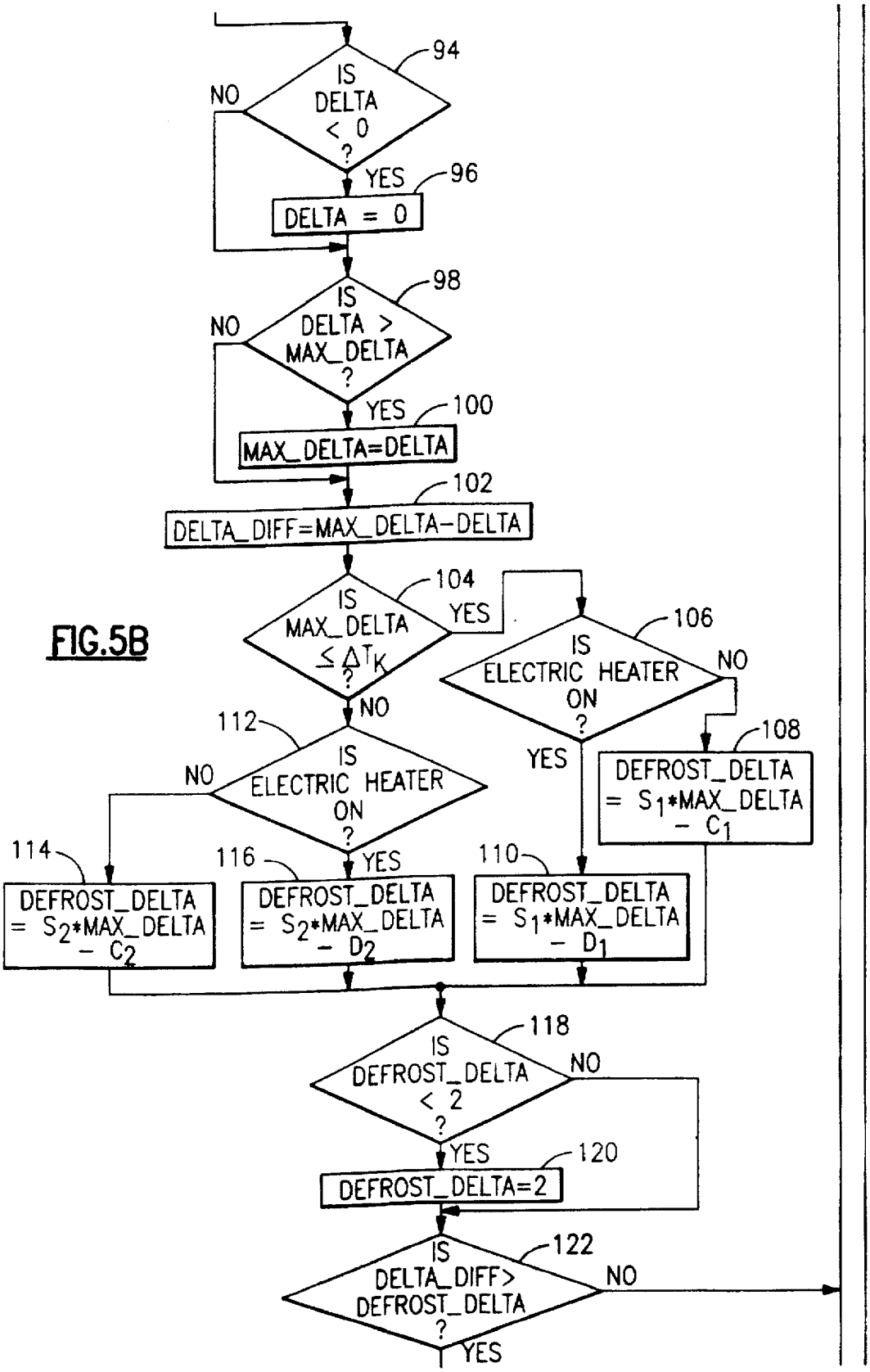
Figure 5C:
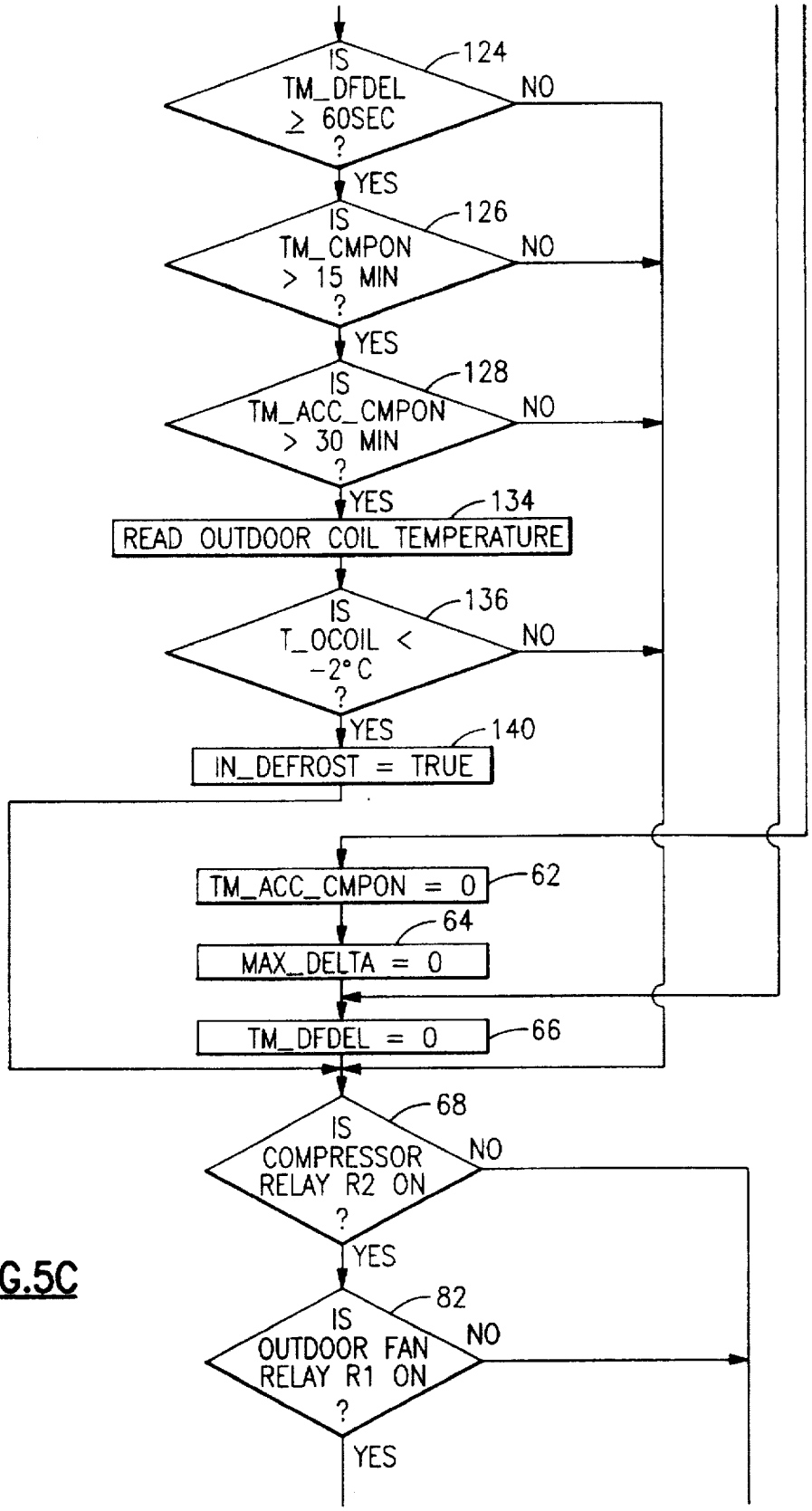
Figure 5D:
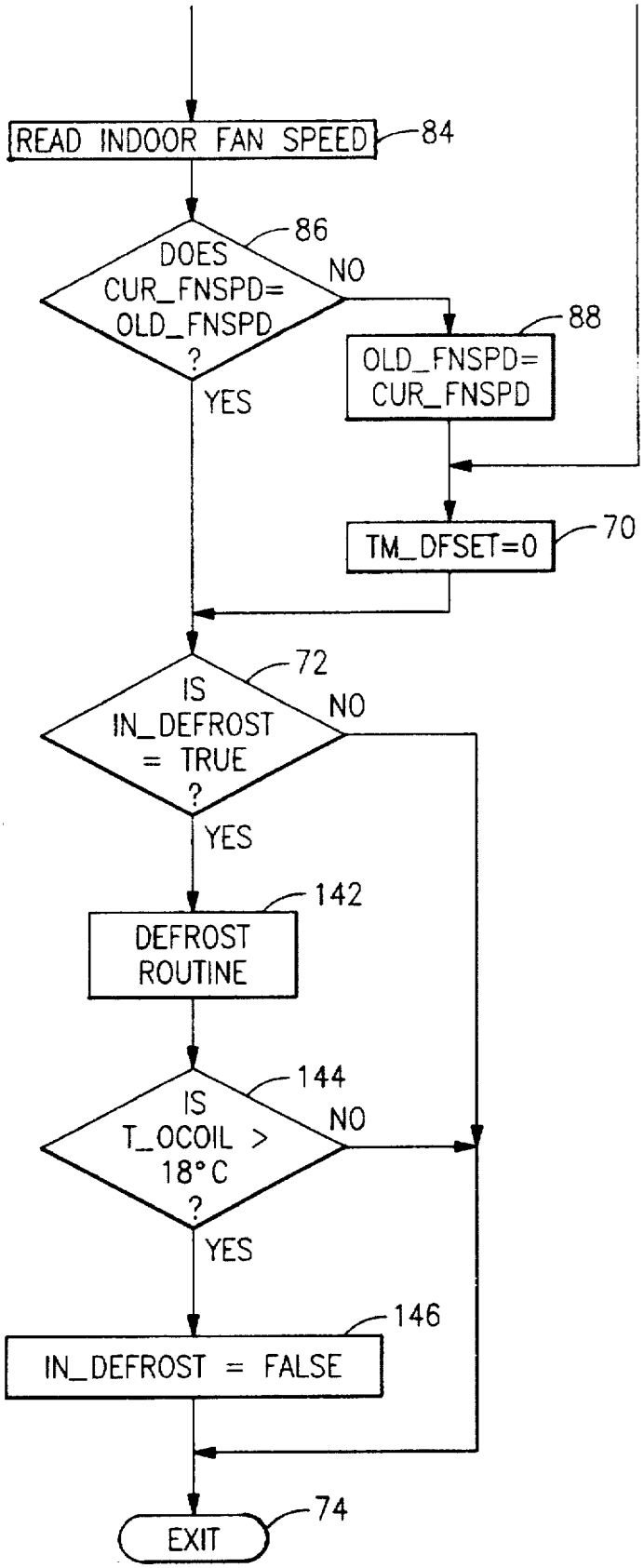

Referring now to FIG. 5A, the process implemented by the control processor 30 so as to timely initiate defrost of the outdoor coil 12 begins with a step 50 wherein inquiry is made as to whether compressor relay R2 is on. Since this relay will initially be set off, the control processor 30 will proceed to a step 52 and inquire as to whether a variable "WAS_ON" is equal to true. Since WAS_ON is false, the processor will proceed along a no path to a step 54. The processor will next proceed to inquire whether the relay compressor R2 is on in step 54 before setting the variable "WAS_ON" equal to false in a step 56. Inquiry will next be made in a step 58 as to whether IN_DEFROST is equal to true. Since IN_DEFROST is initially set equal to false at power up, the control processor will proceed to a step 60 and inquire whether the heat mode has been selected. In this regard, it is to be appreciated that a control panel or other communicating device associated with the control processor 30 will have indicated whether the heat pump system of FIG. 1 is to be in a heat mode of operation. If the heat mode has not been selected, the processor will proceed along a no path to a step 62 in FIG. 5C and set the variable TM_ACC_CMP_ON equal to zero. The processor will also set a variable MAX_DELTA equal to zero in a step 64 and a variable TM_DFDEL equal to zero in a step 66. The control processor continues from step 66 to a step 68 and again inquires as to whether the compressor relay R2 is on. If the compressor relay R2 is not on, the processor proceeds out of step 68 to step 70 and sets TM_DFSET equal to zero. Inquiry is next made as to whether IN_DEFROST is equal to true in a step 72. Since this variable is initially false, the control processor 30 will proceed to an exit step 74.

It is to be appreciated that the control processor 30 will execute various processes for controlling the heat pump system following an exit from the particular logic of FIGS. 5A–5D. The processing speed of the control processor 30 will allow the control processor to return to execution of the logic of FIG. 5A in milliseconds. It is also to be appreciated that at some point a heating mode will be selected and heating will subsequently be initiated by the control processor 30 if the room air temperature as measured by a thermostat is less than a desired temperature setting. When heating is to take place, the control processor 30 preferably turns on the indoor and outdoor fans 22 and 24 as well as the compressor motor 32. The reversing valve 16 will also be set so as to cause refrigerant to flow from of the compressor to the indoor coil 10 and hence to the outdoor coil 12.

Referring to step 50, the control processor will again inquire as to whether the compressor relay R2 is on following the initiation of heating. It is to be appreciated that the compressor relay R2 will have been activated by the processor when heating is called for. The control processor will note the same as having occurred in step 50 and proceed to step 76 to inquire whether the variable WAS_ON is false. Since this variable is currently false, the processor will proceed to a step 78 and turn off the timers associated with TM_CMPON and TM_ACC_CMPON. The processor will next inquire as to whether the compressor relay R2 is on and proceed to step 80 since the compressor relay R2 is now on. This will result in the variable WAS_ON being set equal to true in step 80. The processor will proceed through steps 58 and 60 as previously discussed. Since the heat mode has been selected, the processor will proceed from step 60 to step 81 and inquire whether a timing variable TM_DFSET is greater than sixty seconds. Since this variable will initially be zero, the processor will proceed to step 66 in FIG. 5C and set the timing variable TM_DFDEL equal to zero. The processor will next inquire whether the compressor relay R2 is on in step 68. Since the compressor relay will have been activated by the control processor in response to a demand for heat, the processor will proceed to step 82.

Referring to step 82, the processor inquires whether the outdoor fan relay is on. The outdoor fan relay R1 will normally be on if the heat pump system is responding to a demand for heat. This will prompt the control processor to proceed along the yes path to a step 84 wherein the indoor fan speed is read. It is to be appreciated that the indoor fan will have been activated when heating has been initiated thereby causing the fan speed to be other than zero. This fan speed is available within the control processor as a result of the control processor having commanded the speed by other control software. This fan speed is set equal to the variable CUR_FNSPD and is compared in step 86 with the present value of old fan speed denoted as OLD_FNSPD. Since this latter variable is initially zero, the control processor will proceed out of step 86 to set the old fan speed variable equal to the value of the current fan speed in a step 88. The control processor proceeds to set the timing variable TM_DFSET equal to zero in step 70 before again inquiring whether IN_DEFROST is equal to true in step 72. Since IN_DEFROST is false, the control processor will proceed along the no path from step 72 to exit step 74.

Referring once again to FIG. 5A, it is to be appreciated that the next execution of the defrost logic will again prompt the processor to inquire whether the compressor is on. Since the compressor relay is now on, the processor proceeds to step 76 to inquire as to the status of "WAS_ON". Since this variable is now true, the control processor will proceed to step 54 wherein the compressor relay R2 is again noted as being on, thereby prompting the processor to proceed through steps 80, 58 and 60 to step 81. Referring to step 81, it is to be noted that the processor is examining the time count of TM_DFSET for being greater than sixty seconds. It is to be appreciated that this variable will have begun accruing a count of time once old fan speed was set equal to the current fan speed in step 88. This variable will continue to accrue time during each successive execution of the defrost logic as long as the compressor relay R2 remains on, the outdoor fan remains on, and the indoor fan speed does not change. In this manner, the time count reflected in TM_DFSET will be a measure of the amount of time that the above three conditions of compressor, outdoor fan and indoor fan status have remained constant. The control processor 30 will thereby have imposed a level of consistency on the heat pump system having run without any change to these components for at least sixty seconds.

When the time count maintained by TM_DFSET reaches a value greater than sixty seconds, the control processor will proceed from step 81 to step 90 in FIG. 5A and read the indoor coil temperature provided by thermistor 36 as well as the room air temperature provided by thermistor 38. These values will be stored as T_ICOIL and T_ROOM_AIR. The control processor will proceed in a step 92 to calculate the difference in these measured temperatures as stored in these respective variables. The calculated difference in measured temperatures, DELTA, is next checked for being less than zero in step 94. In the event that the value is less than zero, the control processor sets the same equal to zero in step 96 before proceeding to step 98 wherein an inquiry is made as to whether the measured temperature difference, DELTA, is greater than the value of a variable MAX_DELTA. It is to be appreciated that the value of MAX_DELTA will be zero when the control processor first initiates heating following heating mode have been selected. This will prompt the control processor to set MAX_DELTA equal to the current value of DELTA in step 100. It is to be appreciated that the control processor will most likely continue to adjust the MAX_DELTA equal to the currently computed DELTA as the control processor repeatedly executes the defrost logic and encounters a rising DELTA due to the indoor fan coil temperature rising.

The control processor proceeds to a step 102 from either step 98 in the event that the measured temperature difference of step 92 is less than the presently stored value of MAX_DELTA or in the event that the presently measured value of temperature difference is equal to MAX_DELTA in step 100.

Referring to step 102, the control processor computes the difference between the current value of MAX_DELTA and the current value of DELTA. In the event that the present value of DELTA is less than MAX_DELTA, then the value of the variable DELTA_DIFF in step 102 will be other than zero. Accordingly, the control processor will proceed in a step 104 to inquire whether as to MAX_DELTA is less than or equal to $T_K$. It will be remembered that the value $\Delta T_K$ was arrived at in FIG. 3 as a result of the testing and evaluation of the behavior of the heat pump system. It is to be understood that this value could change in the event that a different heat pump configuration having different system values such as fan speed, fan size or compressor size were tested and an appropriate relationship was developed for the critical permissible difference between maximum delta and current temperature difference.

In the event that MAX_DELTA is less than or equal to $\Delta T_K$, the control processor will proceed to inquire whether the electric heater element 33 is on in a step 106. It is to be appreciated that heat pump systems will often have a secondary heat source or auxiliary heat source available in the event that the heat pump system cannot provide the requisite amount of heat to the interior room being heated. The heat pump system of FIG. 1 includes such a heating element so as to require the particular inquiry of step 106. In the event that the electric heating element 33 is not on or an electric heating element is not present, the control processor will proceed from step 106 to a step 108 and calculate a value of DEFROST_DELTA. It is to be understood that DEFROST_DELTA in this step is the variable $\Delta T_d$ in FIG. 3. It is to be appreciated that the mathematical relationship between DEFROST_DELTA and MAX DELTA is the linear relationship of $\Delta T_d$ to $\Delta T_{MAX}$ for $\Delta T_{MAX}$ less than or equal to $\Delta T_K$ derived from FIG. 3. This relationship could, of course, change in the event that a different heat pump system were tested and the appropriate relationship of $\Delta T_d$ with respect to $\Delta T_{MAX}$ was determined. Referring again to step 106, in the event that an electric heating element is present and on, the control processor proceeds to calculate a defrost delta in a step 110. It is to be noted that the defrost delta in step 110 is lower than that to be calculated in step 108 by two degrees. This particular relationship may be developed by appropriately testing the heat pump system of FIG. 1 and noting the characteristics of frost on the outdoor coil with the auxiliary heating element on.

Referring again to step 104, in the event that the value of MAX_DELTA is not less than or equal to $\Delta T_k$, the control processor will proceed along the no path to a step 112 to inquire whether the electric heating element 33 or an alternative auxiliary heater associated with the heat pump system is on. The control processor will proceed to calculate the appropriate value of DEFROST_DELTA for an electric heater not being on or not being present in step 114 or being present and being on in a step 116. It is to be appreciated that the calculation noted in step 114 is the linear relationship of $\Delta T_d$ versus $\Delta T_{MAX}$ in FIG. 3 for $\Delta T_{MAX}$ greater than $\Delta T_K$. It is furthermore to be appreciated that the value calculated in step 116 reflects the permissible value of defrost delta when an electric heater is present and on. The processor proceeds from having calculated an appropriate value of DEFROST_DELTA in either step 108, 110, 114 or 116 to a step 118 wherein inquiry is made as to whether the calculated value is less than two. In the event that the calculated value is less than two, the control processor adjusts the same to be equal to two in step 120. The control processor will thereafter proceed directly to step 122. It is to be noted that the processor will also have proceeded to step 122 via the no path from step 118 in the event the DEFROST_DELTA is equal to or greater than two.

Referring to step 122, inquiry is made as to whether the computed difference between the maximum temperature difference of the heat pump system and the current measured temperature difference of the heat pump system, as calculated in step 102, is greater than the computed DEFROST_DELTA. It is to be appreciated that the inquiry being made in step 122 is essentially a check as to whether the currently measured temperature difference has decreased to a value that results in the measured temperature difference being more than the value of DEFROST_DELTA below the maximum temperature difference as defined by the value of MAX_DELTA. It is to be appreciated that the value of the currently measured temperature difference will normally not have decreased to such a value since the outdoor coil will normally not experience a significant frost build up. In such situations, the control processor will continue to pursue the no path out of step 122 and proceed through steps 66, 68, 82, 84, 86, 72 and 74, and eventually re-execute the defrost logic of FIGS. 5A–5D. When the heat demand has been satisfied, the control processor will turn the compressor relay R2 off thereby terminating the particular time period of heating. When this occurs, the control processor will note that the compressor relay R2 is off in the next execution of the defrost logic. This will prompt the processor to note that "WAS_ON" being true in step 52 requires execution of a step 123 wherein the time count being stored in "TM_CMPON" and TM_ACC_CMPON is turned off thereby holding these variables at a particular count of time. The control processor resets the time count of TM_CMPON equal to zero in step 123. The control processor does not however reset the time count stored in TM_ACC_CMPON. In this manner, the variable TM_ACC_CMPON continues to accrue a time count each time the compressor is noted as being turned on or off in step 50.

It is to be appreciated that the control processor will continue to timely execute the defrost logic of FIGS. 5A–5D. It will moreover execute steps 50, 76, 54, 80, 58, 60 and 81 and thereafter exit the defrost logic when heat is demanded. This will continue until such time as the heat pump system conditions required in steps 68, 82, 84 and 86 have been satisfied. At this time, the control processor will again proceed to compute the difference in indoor coil and room air temperatures, and thereafter perform the various calculations of MAX_DELTA, DEFROST_DELTA and DELTA_DIFF. This will lead to step 122 wherein inquiry will be made as to whether the currently measured temperature difference, DELTA, has decreased to a value that results in this measured temperature difference being more than the value of DEFROST_DELTA below the maximum temperature difference as defined by the value of MAX_DELTA. In the event that this occurs, the control processor will presume that the outer coil 12 has experienced significant frost requiring a defrost action.

Referring again to step 122, when the value of DELTA_DIFF is greater than the calculated value of DEFROST_DELTA, the control processor will proceed to a step 124 and inquire whether the time value of TM_DFDEL is greater than sixty seconds. This variable will have begun a running count of seconds from the previous complete execution of the defrost logic occurring immediately prior to the control processor first proceeding from step 122 to step 124. Until such time as this variable indicates a value greater than sixty seconds, the control processor will exit step 124 along the no path to step 68 and thereafter normally proceed through step 82, 84, 86 and 72 and hence along the no path out of step 72 to exit step 74. Referring again to step 124, when the control processor has cycled through the defrost logic several times so as to allow the time to build in TM_DFDEL to a time greater than sixty seconds, then the control processor will proceed to step 126. Referring to step 126, inquiry is made as to whether the time value indicated by TM_CMPON is greater than fifteen minutes. It will be remembered that this particular timing variable is turned on in a step 78 following the control processor having noted that the "WAS_ON" variable is false indicating that the compressor 14 had just previously been turned on. This effectively means that the time being recorded by TM_CMPON is indicative of the total amount of time that the compressor 14 has been on since most recently being activated by the control processor. As long as the total amount of time that the compressor has been on since its most recent activation is less than or equal to fifteen minutes, the control processor will proceed along the no path out of step 126 and execute steps 68, 82, 84, 86, 72 and 74 as has been previously discussed. If the total amount of compressor on time since last being activated exceeds fifteen minutes, the control processor will proceed along the yes path from step 126 to a step 128 to inquire whether the time indicated by the variable TM_ACC_CMPON is greater than thirty minutes. Referring to step 62, it is to be noted that the timing variable TM_ACC_CMPON is set equal to zero when the heating mode is not selected as noted in step 60. It is also to be noted that the timing variable TM_ACC_CMPON is also set equal to zero any time the variable IN_DEFROST is true as noted in step 58. As will be discussed in detail hereinafter, the variable IN_DEFROST is only true during a defrost of the outdoor coil. The variable TM_ACC_CMPON is hence allowed to accrue time following a defrost operation. Referring to steps 50, 76 and 78, the variable TM_ACC_CMPON is allowed to accrue time following a defrost action when the timer associated therewith is on in step 78 as a result of the compressor relay having been just turned on. The time recorded by TM_ACC_CMPON will continue to accrue time until the compressor is turned off as noted by the steps 50 and 52. When this occurs, the control processor will proceed to step 123 and turn off the time being recorded by both TM_CMPON as well as TM_ACC_CMPON. The time accrued by TM_ACC_CMPON will merely remain at its present value. Thus when the compressor relay R2 is again turned on, the variable TM_ACC_CMPON will accrue farther time unless a defrost action has occurred or a heat mode has been de-selected. It is to be appreciated that at some point the total amount of compressor on time following a defrost action will have reached thirty minutes.

Referring again to step 128, in the event that the total amount of accumulated compressor on time exceeds thirty minutes, the control processor will proceed to a step 134 to read the outdoor coil temperature from the thermistor 34 and store this value in the variable T_OCOIL. The control processor will next inquire in a step 136 as to whether the outdoor coil temperature value that is stored in the variable T_OCOIL is less than minus two degrees centigrade. If the outdoor coil temperature is not less than minus two degrees Centigrade, the control processor will simply proceed to step 68 and thereafter proceed to exit step 74 as has been previously discussed. Referring again to step 136, in the event that the temperature of the outdoor coil is less than minus two degrees Centigrade, the control processor will proceed to set the variable IN_DEFROST equal to true in a step 140. The control processor will proceed out of step 140 to step 68 and note that the compressor relay is on. This will prompt the processor to proceed to step 82 and inquire whether the outdoor fan relay R1 is on. If the outdoor fan relay R1 is on, the control processor will proceed along the yes path to step 84 and read the indoor fan speed and store this value in CUR_FNSPD. The processor will next compare the value of CUR_FNSPD with the value of OLD_FNSPD in step 86. CUR_FNSPD will be set equal to the value of OLD_FNSPD if necessary in step 88 before the processor sets TM_DFSET equal to zero in step 70 and proceeds to step 72. Since IN_DEFROST is now true, the control processor will proceed along the yes path out of step 72 to a defrost routine in a step 142. It is to be appreciated that the defrost routine will include setting the relay R3 so that the reversing valve 16 will reverse the direction of the refrigerant flow between the fan coils 10 and 12. The defrost routine will also set relay R1 so as to cause the outdoor fan 24 to be turned off. The subsequent reversal of refrigerant flow with the fan 24 being off will cause the outdoor coil to absorb heat from the refrigerant thereby beginning the removal of any frost build up on the coil. The control processor will proceed from step 142 to a step 144 and inquire whether the temperature of the outdoor coil as measured by the thermistor 34 has risen to a temperature greater than eighteen degrees centigrade. It is to be appreciated that the outdoor coil will take some time to rise to a temperature of eighteen degrees Centigrade. This will prompt the processor to continually proceed along the yes path out of step 58 each time the defrost logic of FIGS. 5A–5D is executed. The control processor will proceed from step 58 to steps 62 and 64 and continually set the total accumulated on time variables TM_ACC_CMPON and MAX_DELTA equal to zero. It will also set TM_DFDEL equal to zero in step 66. This effectively initializes all these variables as long as the control processor is implementing a defrost of the outdoor coil 12. The control processor proceeds, after having set the above variables equal to zero, through step 68, 82, 84, 86 and 72 so as to again implement the defrost routine. Referring to step 144 when the outdoor coil temperature rises to a temperature greater than eighteen degrees Centigrade, the control processor will proceed to step 146 and set the variable, IN_DEFROST, equal to false before exiting the defrost logic in step 74. It is to be noted that the next execution of the defrost control logic will prompt the control processor to again encounter step 58 and note that IN_DEFROST is no longer true. The control processor will proceed through step 58 to step 60 as long as the mode of heat continues to remain selected. As has been previously discussed, the processor will exit out of step 81 along the no path until the conditions of the compressor, outdoor fan and indoor fan speed have been satisfied. It is to be appreciated that the value of TM_ACC_CMPON as well as MAX_DELTA will now be able to accrue values other than zero when the compressor relay R2 is on. The maximum delta value will begin to accrue a temperature value when the time denoted by TM_DFSET is greater than sixty seconds, which occurs as soon as the compressor relay and outdoor fan have been turned on plus the indoor fan speed has not changed between successive executions of the logic. As has been previously discussed when TM_DFSET exceeds sixty seconds, the calculation of a DEFROST_DELTA also begin to will occur again. The comparison of the difference between the maximum temperature difference and the measured temperature difference of the indoor coil minus the room air temperature with DEFROST_DELTA will thereafter determine when it is appropriate to examine the various timing values of steps 124, 126 and 128.

It is to be appreciated that a defrost cycle will only be initiated if the further examination of TM_DFDEL and the compressor times denoted by TM_CMPON and TM_ACC_CMPON indicate that appropriate amounts of time have elapsed. Once all of these conditions are satisfied, the variable IN_DEFROST will again be set equal to true allowing the processor to initiate the defrost routine.

While the invention has been described with reference to a preferred embodiment, it will be understood by those skilled in the art that various changes may be made thereto without departing from the scope of the invention. For example, the linear calculations of DEFROST_DELTA in steps 108, 110, 114 and 116 could be replaced by appropriate calculations of defrost delta based on a non-linear relationship between DEFROST_DELTA and the variable MAX_DELTA. Such a calculation would in fact more closely follow the mathematical curve defining the relationship of $\Delta T_d$ to $\Delta T_{MAX}$ in FIG. 3. It is also to be appreciated that the mathematical curve of FIG. 3 could change in the event that a different heat pump system having different compressor fan and other heat pump characteristics were analyzed. Such a heat pump system could be similarly tested and the appropriate relationship defined as discussed with respect to FIGS. 2 and 3. For the above reasons, it is therefore intended that the invention not be limited to the particular embodiment disclosed, but that the invention include all the embodiments falling within the scope of the claims hereinafter set forth.

What is claimed is:

1. A method for controlling the initiation of a defrost action in a heat pump system comprising the steps of:

noting the difference in temperature between the temperature of an indoor coil of the heat pump system and the room air temperature of the room being heated by the heat pump system;

computing any difference between the noted difference in temperature and a maximum temperature difference that has been noted as having occurred between the indoor coil temperature and the room air temperature following a previous defrost action of the outdoor coil;

computing a limit for the difference between the noted difference in temperature and the noted maximum temperature difference between the indoor coil temperature and the room air temperature that establishes a threshold for potentially initiating a defrost of the outdoor coil of the heat pump system wherein the limit that establishes a threshold for potentially initiating a defrost is computed as a function of the value of the noted maximum temperature difference; and determining whether a defrost action of the outdoor coil of the heat pump system should be activated when the computed difference between the noted difference in temperature and the noted maximum temperature difference between the indoor coil temperature and the room air temperature exceeds the computed limit that establishes a threshold for potentially initiating a defrost.

2. The method of claim 1 wherein said step of noting the difference in temperature between the temperature of the indoor coil of the heat pump system and the room air temperature and said step of computing any difference between the noted difference in temperature and the maximum temperature difference that has been noted and said step of computing a limit for the difference between the noted difference in temperature and the noted maximum temperature difference are repeated at least once following a determination that a computed difference between the noted difference in temperature between temperature of the indoor coil and the room air temperature and the noted maximum temperature difference exceeds the computed limit that establishes a threshold for potentially initiating a defrost so as to confirm that the computed difference continues to exceed the computed limit before proceeding with any defrosting action of the outdoor coil.

3. The method of claim 2 wherein said step of determining whether a defrost action of the outdoor coil should be activated further comprises the steps of:

determining whether the compressor has been continuously on for a predetermined period of time; and proceeding to further determine whether a defrost action should be initiated only after the compressor has been continuously on for the predetermined period of time.

4. The method of claim 3 wherein said step of proceeding to further determine whether a defrost action of the outdoor coil should be initiated comprises the step of:

determining whether the compressor has been on for a predetermined period of accumulated time since the outdoor coil of the heat pump system was previously defrosted.

5. The method of claim 4 wherein said step of determining whether the compressor has been on for a predetermined period of accumulated time comprises the steps of:

monitoring the on time of the compressor following termination of a previous defrost action;

incrementally adding any presently monitored on time to a sum of previously monitored on time of the compressor after the previous defrost action so as to produce a present sum of on time of the compressor;

comparing the present sum of compressor on time with the second predetermined period of time; and proceeding to further determine whether a defrost action should be initiated when the present sum of on time exceeds the predetermined period of accumulated time since the outdoor coil of the heat pump system was defrosted.

6. The method of claim 1 wherein said step of computing a limit for the difference between the noted difference in temperature and any previous noted maximum temperature difference between the indoor coil temperature and the room temperature that establishes a threshold for potentially initiating a defrost of the outdoor coil comprises the steps of:

detecting whether an auxiliary heater is on; and computing a first limit for the difference between the noted difference in temperature and the noted maximum temperature difference between the indoor coil and the room air temperature that establishes a threshold for potentially initiating a defrost of the outdoor coil when the auxiliary heater is on and a second limit for the difference that establishes a threshold for potentially initiating a defrost of the outdoor coil when the auxiliary heater is off.

7. The method of claim 1 wherein said step of computing a limit for the difference between the noted difference in temperature and the noted maximum temperature difference between the indoor coil temperature and the room temperature that establishes a threshold for potentially initiating a defrost of the outdoor coil comprises the steps of:

noting the current value of the maximum temperature difference between the indoor coil and the room air temperature; and computing the limit for the difference between the noted difference in temperature and the current value of the maximum temperature difference between the indoor coil and the room air temperature that establishes a threshold for potentially initiating a defrost of the outdoor coil in accordance with a defined relationship between the limit for the difference that establishes a threshold for potentially initiating a defrost of the outdoor coil and maximum temperature difference for the current value of maximum temperature difference.

8. The method of claim 1 wherein the limit being computed as a function of the value of the noted maximum temperature difference is derived from observing a heat pump system of the same design operate under a variety of different system and ambient conditions and noting the maximum difference between indoor coil temperature and room air temperature of the particularly designed system and the drop in temperature from a maximum noted indoor coil temperature when substantial frosting of the outdoor coil occurs during each such observed operation whereby a relationship is developed between noted maximum difference between indoor coil temperature and room air temperature and the drop from the noted maximum indoor coil temperature.

9. The method of claim 1 wherein said step of computing any difference between the noted difference in temperature and the noted maximum temperature difference comprises the steps of:

determining whether the noted difference in temperature between the temperature of the indoor coil and the room air temperature exceeds any previously noted maximum difference between the indoor coil temperature and the room air temperature that has occurred following a previous defrost of the outdoor coil; and storing the noted difference as the maximum difference of indoor coil temperature and room air temperature when the noted difference exceeds the previously noted maximum difference between the indoor coil temperature and the room air temperature following a previous defrost of the outdoor coil.

10. The method of claim 1 further comprising the steps of:

detecting whether a predetermined period of time has elapsed during which the speed of an indoor fan associated with the indoor coil has remained constant while both a compressor in the heat pump system and a fan associated with the outdoor coil have remained on; and proceeding to said step of noting the difference in temperature between the temperature of the indoor coil of the heat pump system and the room air temperature of the room being heated by the heat pump system when the predetermined period of time has elapsed.

11. The method of claim 10 wherein said step of detecting whether a predetermined period of time has elapsed during which the speed of an indoor fan associated with the indoor coil has remained constant while both a compressor in the heat pump system and a fan associated with the outdoor coil have remained on further comprises the steps of:

establishing a count of the predetermined period of time that must elapse during which the speed of the indoor fan must remain constant while both the compressor and fan associated with the outdoor coil must remain on; and resetting the count of the predetermined time when either the indoor fan speed changes, the compressor is turned off or the fan associated with the outdoor coil is turned off.

12. The method of claim 1 wherein said step of noting the difference in temperature between the temperature of an indoor coil of the heat pump system and the room being heated by the heat pump system comprises the steps of:

repetitively reading both the temperature of the indoor coil of the heat pump system and the room air temperature of the room being heated by the heat pump system;

repetitively computing the difference between both read temperatures so as to repetitively define differences in temperature between the temperature of the indoor coil and the room air temperature of the room being heated by the heat pump system; and noting at least some of the repetitively defined differences between the temperature of the indoor coil and the room air temperature.

13. The method of claim 12 further comprising the step of:

noting the maximum difference between the temperature of the indoor coil and room temperature of the room being heated by the heat pump system from among the repetitively computed differences of both temperatures.

14. A system for controlling the initiation of a defrost action in a heat pump comprising:

a sensor for sensing a temperature of an indoor coil of the heat pump system;

a sensor for sensing a temperature of the space being heated by the heat pump;

a device for defrosting the outdoor coil of the heat pump; and computer means operative to repetitively read both the sensed temperature of the indoor coil from the sensor for sensing the temperature of the indoor coil and the sensed temperature of the space being heated from the sensor for sensing the temperature of the space being heated and to thereafter compute a difference in both read temperatures, said computer means being furthermore operative to repetitively determine the maximum temperature difference in both read temperatures to have occurred since the last defrosting of the outdoor coil, said computer means furthermore being operative to compute and thereafter compare any difference between the then determined maximum temperature difference in both read temperatures and the most recent difference in both read temperatures with a permissible limit as to the difference between the then determined maximum temperature difference in both read temperatures and the most recent difference in both temperatures, whereby said computer means is operative to send a defrost signal to said device for defrosting the outdoor coil when the computed difference between the then determined maximum temperature difference in both read temperatures and the most recent difference exceeds the permissible limit and the computer means has noted that a particular component of the heat pump has been operational over a predetermined period of time.

15. The system of claim 14 wherein said computer means is operative to compute the permissible limit as to the difference between the then determined maximum temperature difference in both read temperatures and the most recent difference, the permissible limit being computed as a function of the value of the then determined maximum difference in both read temperatures.

16. The system of claim 15 wherein said computer means is operative to confirm through at least one further successive reading of the sensed temperature of the indoor coil and the sensed temperature of the space following a computed difference between the then determined maximum temperature difference in both read temperatures and the most recent difference between the read temperatures exceeding the permissible limit that a resulting computed difference between the then determined maximum difference in both read temperatures and the difference in the successively read temperatures indicates the resulting computed difference also exceeds the permissible limit before sending the defrost signal to said device for defrosting the outdoor coil.

17. The system of claim 14 wherein the particular component of the heat pump being noted as having been operational is a compressor within the heat pump.

18. The system of claim 14 wherein said defrost device comprises:

a reversing valve within the heat pump for reversing the flow of refrigerant within the heat pump.

19. The system of claim 14 wherein said heat pump includes an indoor fan associated with the indoor coil and an outdoor fan associated with an outdoor coil and wherein said computer means is operative to verify that the running status of the fans has not changed before proceeding to repetitively read both the sensed temperature of the indoor coil and the sensed temperature of the space being heated by the heat pump.

20. The system of claim 14 further comprising:

a sensor for sensing the temperature in the vicinity of the outdoor coil, and wherein said computer means is operative to condition the sending of the defrost signal to said device for defrosting the outdoor coil depending on the value of the temperature read from said sensor for sensing the temperature in the vicinity of the outdoor coil.

* * * * *